US010609768B2

(12) United States Patent
Rateiczak et al.

(10) Patent No.: US 10,609,768 B2
(45) Date of Patent: Mar. 31, 2020

(54) DISC HAVING AT LEAST TWO ELECTRICAL CONNECTION ELEMENTS AND CONNECTING CONDUCTORS

(71) Applicant: SAINT-GOBAIN GLASS FRANCE, Courbevoie (FR)

(72) Inventors: Mitja Rateiczak, Wuerselen (DE); Bernhard Reul, Herzogenrath (DE); Klaus Schmalbuch, Aachen (DE); Bernd Stelling, Bielefeld (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 418 days.

(21) Appl. No.: 15/031,712

(22) PCT Filed: Oct. 7, 2014

(86) PCT No.: PCT/EP2014/071395

§ 371 (c)(1),
(2) Date: Apr. 22, 2016

(87) PCT Pub. No.: WO2015/062820

PCT Pub. Date: May 7, 2015

(65) Prior Publication Data

US 2016/0270159 A1 Sep. 15, 2016

(30) Foreign Application Priority Data

Oct. 29, 2013 (EP) ..... 13190646

(51) Int. Cl.
*H05B 1/02* (2006.01)
*H05B 3/84* (2006.01)
*H05B 3/20* (2006.01)

(52) U.S. Cl.
CPC ..... *H05B 3/84* (2013.01); *H05B 3/20* (2013.01); *H05B 2203/016* (2013.01)

(58) Field of Classification Search
CPC ..... H05B 3/84; H05B 3/20; H05B 2203/016; H05B 1/02; H05B 2203/031; H05B 3/0042; H05B 1/0236
(Continued)

(56) References Cited

U.S. PATENT DOCUMENTS 4,023,008 A 5/1977 Durussel
4,415,116 A 11/1983 Norton
(Continued)

FOREIGN PATENT DOCUMENTS

GB 2068715 A 8/1981
JP H01-158662 U 11/1989
(Continued)

OTHER PUBLICATIONS

International Search Report for International Application No. PCT/EP2014/071395 filed on Oct. 7, 2014 in the name of Saint-Gobain Glass France. dated Jan. 30, 2015 (English translation & German original) 5 pages.
(Continued)

*Primary Examiner* — Mark H Paschall
(74) *Attorney, Agent, or Firm* — Pillsbury Winthrop Shaw Pittman LLP

(57) ABSTRACT

A pane having at least two connection elements and one connecting conductor is described. The pane comprising a substrate with an electrically conductive structure on at least one subregion of the substrate, at least two electrical connection elements on at least one subregion of the electrically conductive structure, at least one contact area on the bottom of each connection element, a solder compound, which connects the contact areas of the electrical connection elements in at least one subregion to the electrically conductive structure, and a connecting conductor, which electrically conductively connects the connection elements to one
(Continued)

Figure 1:
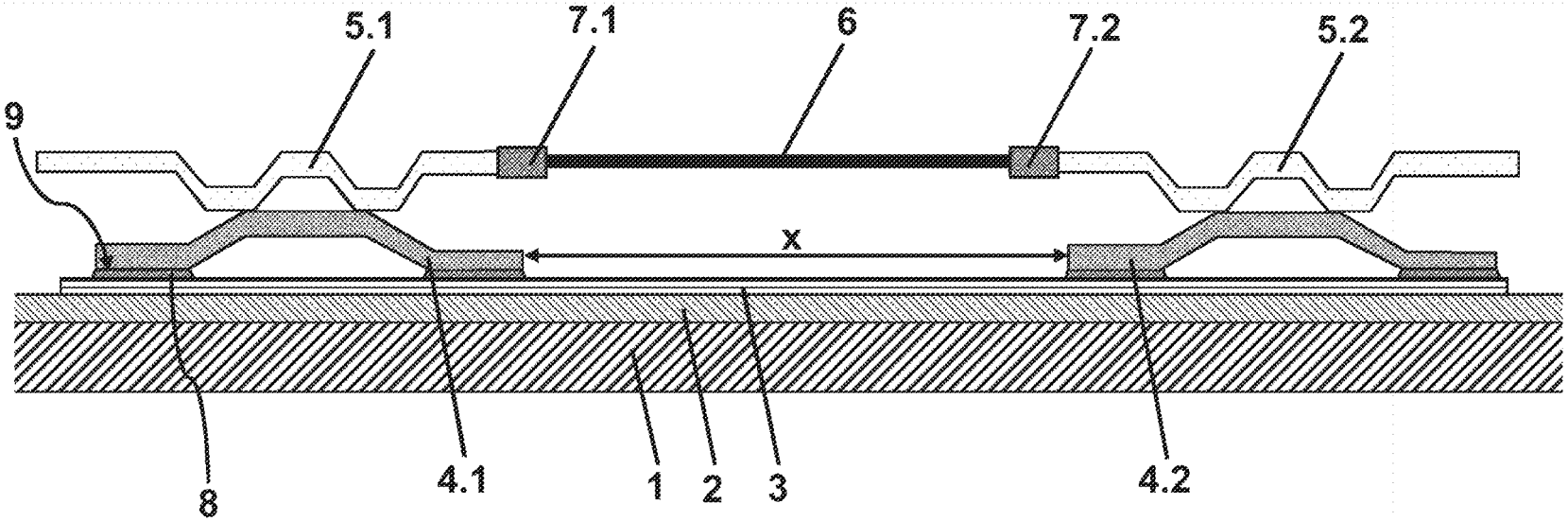

another, wherein the contact areas of adjacent connection elements, which contact areas are closest to one another, are at a distance of at least 70 mm.

22 Claims, 7 Drawing Sheets

(58) Field of Classification Search
USPC ..... 219/203, 202, 494, 541, 543
See application file for complete search history.

(56) References Cited

U.S. PATENT DOCUMENTS 6,320,159 B1 * 11/2001 Topp ..... H05B 3/84 219/203
6,406,337 B1 6/2002 Machado
2006/0102610 A1 5/2006 Hoepfner et al.
2010/0000982 A1 * 1/2010 Allgaier ..... F23Q 7/001 219/270
2011/0315312 A1 12/2011 Luo
2013/0043066 A1 * 2/2013 Cholewa ..... H01R 4/023 174/257

FOREIGN PATENT DOCUMENTS

JP H06-013060 U 2/1994
JP H08-162260 A 6/1996
JP 2004-189023 A 7/2004
WO WO 2012/139883 A1 10/2012

OTHER PUBLICATIONS

Written Opinion for International Application No. PCT/EP2014/071395 filed Oct. 7, 2014 on behalf of Saint-Gobain Glass France. dated Jan. 30, 2015. (English Translation + German Original). 20 pages.

* cited by examiner

DISC HAVING AT LEAST TWO ELECTRICAL CONNECTION ELEMENTS AND CONNECTING CONDUCTORS

CROSS REFERENCE TO RELATED APPLICATIONS

The present application is the U.S. national stage entry of International Patent Application No. PCT/EP2014/071395, filed internationally on Oct. 7, 2014, which, in turn, claims priority to European Patent Application No. 13190646.3, filed on Oct. 29, 2013.

The invention relates to a pane with at least two electrical connection elements and a connecting conductor, an economical and environmentally friendly method for its production, and its use.

The invention further relates to a pane with at least two electrical connection elements and a connecting conductor for motor vehicles with electrically conductive structures, such as, for instance, heating conductors or antenna conductors. The electrically conductive structures are customarily connected to the onboard electrical system via soldered-on electrical connection elements.

in the modern automobile industry, an optically pleasing design is increasingly gaining significance; thus, for example, the attempt is made to maximize the transparent area of the glazings. The nontransparent black print customarily applied on the edge of the glazing serves for both the adhesion of the pane to the car body and for masking the busbars. In order to keep the fraction of the black print as small as possible, the width of the busbars and the adhesive surface must be minimized. A smaller width of the busbars results, however, in a reduced current-carrying capacity, since, with unchanged thickness of the busbar, the conductor cross-section is also reduced. Thus, an adequate heating output of the heating element can no longer be guaranteed. A simple contacting with the previously described connection elements is in this case no longer adequate.

With an excessively reduced current-carrying capacity of the busbars, an additional connecting conductor can be used according to the prior art to increase the heating output. This connecting conductor is mounted on the busbar and electrically conductively connected thereto at regular intervals.

U.S. Pat. No. 4,415,116 discloses a busbar on which an additional connecting conductor is mounted, whose free end is connected to the onboard voltage. The connecting conductor consists of a braided copper cable that is attached on the busbar at intervals of 50 mm each by means of a solder point. The connecting conductor minimizes an unwanted voltage drop on the busbars that would result in unwanted heating of the busbars. The solder connections between the busbar and the connecting conductor applied within short intervals are, according to U.S. Pat. No. 4,415,116, necessary to minimize the length of the current paths in the region of the busbar. This is supposed to further reduce the voltage drop on the busbars and the resulting heat losses such that the heating output of the heating elements is optimized.

From practice, similar solutions are known, wherein a nickel-plated copper conductor is applied on the busbar by a plurality of solder points, with a crimp made in the copper conductor at each solder point. In such implementations as well, the solder points are arranged within short intervals of less than 60 mm.

The connecting conductors known from the prior art are, on the one hand, expensive due to a high material outlay and, on the other, complex to work with since they have a large number of solder points.

The object of the invention is to provide a pane with at least two electrical connection elements and a connecting conductor as well as an economical and environmentally friendly method for its production, wherein the connection elements with connecting conductors can be manufactured both cost-effectively and simply using automation.

The object of the present invention is accomplished according to the invention by means of a pane with at least two electrical connection elements and a connecting conductor, a method for its production, and its use according to the independent claims 1, 13, and 15. Preferred embodiments become evident through the dependent claims.

The pane according to the invention with at least two connection elements and a connecting conductor comprises at least

- a substrate with an electrically conductive structure on at least one subregion of the substrate,
- at least two electrical connection elements on at least one subregion of the electrically conductive structure,
- at least one contact surface on the bottom of each connection element,
- a soldering compound, which connects the contact surfaces of the electrical connection elements in at least one subregion to the electrically conductive structure, and
- a connecting conductor, which connects the connection elements electrically conductively to each other, wherein the contact surfaces of adjacent connection elements nearest each other have a distance x between them of at least 70 mm.

The distance x is measured between the edges nearest each other of the contact surfaces of adjacent connection elements nearest each other.

The use according to the invention of a connecting conductor, which spans the connection elements applied on the electrical structure, results in a substantial improvement of the heating output of the pane. In this manner, even narrow busbars with low current-carrying capacity can be used without losses of heating output. In contrast to the solutions known according to the prior art, the connection elements of the pane according to the invention have a distance between them of at least 70 mm. Thus, substantially longer stretches on which the connecting conductor is not fixed by a solder point can be bridged by the connecting conductor according to the invention. At the time of assembly of the connection elements with the connecting conductor, substantially fewer solder points are thus necessary with the same length of the connecting conductor than according to the prior art. It was thus possible to refute the preconception mentioned in U.S. Pat. No. 4,415,116 that short distances between the solder points (50 mm) are necessary to increase the heating output.

In a preferred embodiment, the contact surfaces of adjacent connection elements nearest each other have a distance between them of at least 100 mm, preferably at least 150 mm, particularly preferably at least 200 mm. Even these long distances can be bridged by means of the connection elements according to the invention with connecting conductors without a loss of heating output occurring compared to solutions known according to the prior art. The arrangement according to the invention is particularly advantageous in the case of long connecting conductors because a reduction in the number of solder points results in a substantial cost reduction. The production complexity also increases with the number of solder points to be applied. Moreover, with a large number of solder points, the method can no longer be performed using automation. Thus, the number of solder points should be minimized as much as possible.

The connecting conductor includes a conductive core and a nonconductive sheathing. The conductive core is a metal conductor. The conductive core of the connecting conductor can contain, for example, copper, aluminum, and/or silver or alloys or mixtures thereof. The conductive core can, for example, be implemented as a stranded conductor or as a solid wire conductor. Electrical conductors usable for this purpose are adequately known to the person skilled in the art. The nonconductive sheathing (insulation cladding) forms electrical insulation of the conductive core. Preferably, the nonconductive sheathing is polymer-containing, particularly preferably containing polyvinyl chloride and/or polytetrafluoroethylene. In addition to electrical insulation of the conductive core, the nonconductive sheathing also has, on the other hand, the objective of preventing the development of noise in the motor vehicle. Since the connecting conductor is fixed only on the connection elements, the part situated between these elements is freely movable and can, during driving, strike the busbar located below it, as a result of which, noise development can occur without corresponding countermeasures. The nonconductive sheathing damps such striking of the connecting conductor on the busbar and thus prevents bothersome noise development.

In another possible embodiment, the nonconductive sheathing of the connecting conductor additionally contains a foamed-on polymer, preferably polypropylene, polyethylene, polystyrene, polyethylene terephthalate, and/or mixtures and/or copolymers thereof. This results in a further improvement of noise damping.

The connecting conductor has a conductor cross-section less than or equal to 6 $mm^2$, preferably less than or equal to 4 $mm^2$, particularly preferably less than or equal to 2.5 $mm^2$. The conductor cross-section of the connecting conductor is selected as small as possible in order to achieve a material and weight savings. Even such small conductor cross-sections of the connecting conductor are surprisingly adequate to achieve a sufficiently high heating output. In a most particularly preferred embodiment, the conductor cross-section of the connecting conductor is 1.5 $mm^2$ to 2.5 $mm^2$.

The connection elements are, in a preferred embodiment, connected via their top to the connecting conductor. In the context of the invention, the "top" of the connection elements is the surface that is turned away from the contact surfaces of the connection elements with the electrically conductive structure (solder surfaces). The connecting conductor is preferably mounted on the top of the connection elements.

The electrically conductive structure can, for example, serve for the contacting of pane-mounted wires or a coating. The electrically conductive structure is, for example, mounted in the form of busbars on opposing edges of the pane. The electrically conductive structure comprises at least one busbar with a conductor cross-section less than 0.3 $mm^2$, preferably less than 0.1 $mm^2$, particularly preferably less than 0.06 $mm^2$. Through the use of the connection elements according to the invention with a connecting conductor, even busbars with small conductor cross-sections can be realized with adequate heating output at the same time.

A voltage can be applied via the connection elements mounted on the busbars, by means of which a current flows from one busbar to the other through the conductive wires or a conductive coating and heats the pane. Alternatively to such a heating function, the pane according to the invention is also usable in combination with antenna conductors or is even conceivable in any other arrangement.

The busbars have a width less than or equal to 10 mm, preferably less than or equal to 8 mm, particularly preferably less than or equal to 6 mm. Such narrow busbars are particularly advantageous, since the black print for masking the busbars need only have a low width. Thus, the transparent fraction of the glazing can be increased.

The layer thickness of the busbars is less than or equal to 16 μm, preferably less than or equal to 12 μm, particularly preferably less than or equal to 10 μm. A reduction of the layer thickness of the busbars results in a saving of material and thus also in cost reduction. The layer thickness of the busbars must, accordingly, be kept as small as possible, with the connecting conductor according to the invention also enabling the use of very thin layer thicknesses of, for example, 8 μm.

In a preferred embodiment, the pane includes two connection elements, between which a connecting conductor with a length less than or equal to 300 mm extends. To bridge this distance of a maximum of 300 mm, two connection elements on the ends of the connecting conductor suffice, with no additional fixings of the connecting conductor being necessary. Even with regard to the heating output, the use of two connection elements is adequate.

In another preferred embodiment, the pane includes at least three connection elements, with the connecting conductor having a length greater than 300 mm. In this case, the connecting conductor is divided into individual sections which extend, in each case, from one connection element to the next connection element.

The connection elements can contain an extremely wide variety of materials and alloys known to the person skilled in the art. The connection elements preferably contain titanium, iron, nickel, cobalt, molybdenum, copper, zinc, tin, manganese, niobium, and/or chromium and/or alloys thereof. The material composition of the connection element can be adapted to the material composition of the solder used. In conjunction with lead-containing solders, connection elements containing copper are preferably used. In a preferred embodiment, the connection element contains iron alloys or titanium and is thus particularly suited for combination with lead-free soldering compounds.

The material thickness of the connection element is preferably 0.1 mm to 2 mm, particularly preferably 0.2 mm to 1.5 mm, most particularly preferably 0.4 mm to 1 mm. In a preferred embodiment, the material thickness of the connection element is constant over its entire area. This is particularly advantageous with regard to simple production of the connection element.

The connection elements have, in each case, at least one contact surface, via which the connection element is connected to a subregion of the electrically conductive structure over its entire surface by means of the soldering compound. The connection elements can be implemented in an extremely wide variety of geometries. Even simple shapes with only one contact surface, such as, for example, crimps, can be used as connection elements. Moreover, the connection elements can also be implemented in the shape of a bridge or in the form of a snap.

In a preferred embodiment, the connection element is stamped in the shape of a bridge, with the connection element having two feet for contacting the electrically conductive structure, between which feet there is a raised section, which does not make direct surface contact with the electrically conductive structure. The connection element can have both a simple bridge shape and also include more complex bridge shapes. For example, a dumbbell shape with rounded feet that both effect uniform tensile stress distribution and enable uniform solder distribution is conceivable. The use of bridge-shaped connection elements is particularly advantageous since the current applied splits into two subcurrents that each enter the electrically conductive structure via one solder foot of the connection element and thus enable uniform current distribution.

The electrical contacting of the connecting conductor with the connection elements can occur via a solder connection, a weld connection, a crimp connection, or a plug connection.

The connecting conductor can be set on the relevant connection element at an angle from 45° to 180° relative to the longitudinal direction of the connection element. At an angle of 180°, the connecting conductor runs beyond the contact surface in the direction of the nearest connection element. Thus, a mounting point necessary for the electrode in the case of resistance soldering is obscured by the connecting conductor. This can, for example, be avoided through the use of plug connections and the subsequent mounting of the connecting conductor. If the contacting between the connecting conductor and the connection element is not to be reversible, mounting by means of induction soldering is alternatively possible. If obscuring of the contact surface is undesirable, this can be avoided by modification of the angle between the connecting conductor and the connection element. In a possible embodiment, the connecting conductor is set on the connection element at an angle of 90° relative to the longitudinal direction of the connection element. However, it has been demonstrated in practice that an angle of 45° already suffices to ensure adequate accessibility of the electrode mounting points.

At least one connection element is connected to the onboard electronic system of the motor vehicle via a connection cable. The electrical contacting of the connection elements to the connection cables can likewise occur via a solder connection, a weld connection, a crimp connection, or a plug connection.

In the simplest conceivable embodiment, the connecting conductor and the connection cable are mounted directly on the connection element for example, via a solder connection.

In a preferred embodiment, the connecting conductor and/or the connection cable are contacted to the connection element via contact elements. The connecting conductor and the connection cable can be both jointly mounted via one contact element and also mounted via different contact elements. In a possible embodiment, the connecting conductor and the connection cable are implemented as a one-piece cable, with the nonconductive sheathing of the cable removed in the region of one connection element, and the conductive core is electrically conductively contacted to the connection element, for example, via a crimp.

The contact elements are electrically conductively connected to the connection elements, with the possibility of connecting the elements by means of different soldering or welding techniques. Preferably, the contact elements and the connection elements are connected by means of electrode resistance welding, induction soldering, ultrasonic welding, or friction welding. Moreover, even a one-piece implementation of the connection element and the contact element is conceivable.

Crimps or contact pins that can be realized both in one piece with the connection element and also in a multipart embodiment can, for example, be used as contact elements. Even the top female part of a snap serves in this connection as a contact element on which the connecting conductor and/or the connection cable are fixed.

The use of contact elements is advantageous in the context of standardization enabled thereby. The connection elements and the connecting conductor are stocked separately and assembly of the individual module does not occur until needed. Thus, connecting conductors of different lengths can be combined in a simple manner with any connection elements via contact elements. Such a modular structure enables high flexibility and variant variety with low production costs at the same time.

In a preferred embodiment, the contact element is dimensioned such that standardized flat automotive plugs with a height of 0.8 mm and a width of either 4.8 mm, 6.3 mm, or 9.5 mm can be plugged onto at least one free end of the contact element. The embodiment of the contact element with a width of 6.3 mm is particularly preferably used, since this corresponds to the flat automotive plugs according to DIN 46244 conventionally used in this sector. Standardizing the contact element adapted to the size of the conventional flat automotive plug yields a simple and also reversible capability for connecting the conductive structure of the substrate to the onboard voltage. In the event of a broken connection cable or connecting conductor, no soldered connection has to be redone to exchange the defective part; instead, the replacement cable is merely plugged onto the contact element. Moreover, the use of plug connections is particularly advantageous with regard to a modular structure of the system and standardization.

In a particularly preferred embodiment, the contact element is structured symmetrically and has two contact pins. A symmetrical shape serves for homogeneous power absorption of the contact element during processing, for example, homogeneous heat distribution at the time of soldering and welding processes. On such a contact element, the connecting conductor is contacted on a first contact pin and a connection cable on a second contact pin. Such a structure also makes sense in the context of standardization and modular structure so long as only one slot is necessary for a connecting conductor.

In one possible embodiment, the connection element and the contact element are formed in one piece.

Alternatively, the electrical contacting of the contact element can also occur via a solder connection or a crimp connection.

Usable connection cables are, in principle, all cables known to the person skilled in the art for electrical contacting of an electrically conductive structure. The connection cable can include, in addition to an electrically conductive core (internal conductor), an insulating, preferably polymeric, sheathing, with the insulating sheathing preferably removed in the end region of the connection cable to enable an electrically conducting connection between the connection element and the internal conductor.

The electrically conductive core of the connection cable can contain, for example, copper, aluminum, and/or silver or alloys or mixtures thereof. The electrically conductive core can be implemented, for example, as a stranded conductor or as a solid wire conductor. The cross-section of the electrically conductive core of the connection cable is determined by the current-carrying capacity necessary for the use of the pane according to the invention and can be suitably selected by the person skilled in the art. The cross-section is, for example, from 0.3 $mm^2$ to 6 $mm^2$.

The connection cable has, on its free end, which is not connected to the contact element or the connection element, a plug connector, via which the connection to the onboard electronic system of the motor vehicle occurs.

The connection cable is, in a particularly preferred embodiment, resistant to bending. Thus, the end plug connection of the connection cable can be connected in a simple manner to the onboard voltage without the force applied at the time of plugging resulting in unwanted deformation of the connection cable. The plug connection can thus even be accomplished with one hand and, therefore, constitutes a simplification of the production process. The stiffening of the cable is preferably done by means of a bending-resistant sheathing.

The electrically conductive structure contains at least silver, preferably silver particles and glass frits.

The electrically conductive structure is electrically conductively connected to the connection elements via the soldering compound. The soldering compound is arranged on the contact surfaces that are situated on the bottom of the connection elements. All soldering compounds known to the person skilled in the art that are suitable for working on glass can be used. Preferably, the soldering compound includes tin, bismuth, indium, zinc, copper, silver, lead, and/or mixtures and/or alloys thereof.

In a preferred embodiment of the invention, the soldering compound is lead-free. This is particularly advantageous with regard to the environmental impact of the pane according to the invention with an electrical connection element. In the context of the invention, "lead-free soldering compound" means a soldering compound that includes, in accordance with EC Directive "2002/95/EC on the Restriction of the Use of Certain Hazardous Substances in Electrical and Electronic Equipment", a lead fraction less than or equal to 0.1 wt.-%, preferably no lead.

Lead-free soldering compounds typically have less ductility than lead-containing soldering compounds, such that mechanical stresses between a connection element and a pane can be less well compensated. However, it has been demonstrated that critical mechanical stresses can be prevented through a suitable selection of the material of the connection element. The material composition of the connection element is selected such that the difference in the coefficients of thermal expansion of the transparent substrate and of the connection element is less than $5\times10^{-6}/°$ C. Thus, the thermal stresses of the pane are reduced and better adhesion is achieved. Titanium and chromium-containing steel can be mentioned here as particularly suitable materials.

Advantageous materials of the connection elements that are used in conjunction with lead-free soldering compounds are presented in the following.

The connection element contains, in an advantageous embodiment, a chromium-containing steel with a chromium content greater than or equal to 5 wt.-%, preferably greater than or equal to 10.5 wt.-%. Other alloy components such as molybdenum, manganese, or niobium result in improved corrosion resistance or altered mechanical properties, such as tensile strength or cold formability.

The connection element preferably contains at least 49 wt.-% to 95 wt.-% iron, 5 wt.-% to 30 wt.-% chromium, 0 wt.-% to 1 wt.-% carbon, 0 wt.-% to 10 wt.-% nickel, 0 wt.-% to 2 wt.-% manganese, 0 wt.-% to 5 wt.-% molybdenum, 0 wt.-% to 2 wt.-% niobium, and 0 wt.-% to 1 wt.-% titanium. The connection element can additionally contain admixtures of other elements, including vanadium, aluminum, and nitrogen.

The connection element more preferably contains at least 57 wt.-% to 93 wt.-% iron, 7 wt.-% to 25 wt.-% chromium, 0 wt.-% to 1 wt.-% carbon, 0 wt.-% to 8 wt.-% nickel, 0 wt.-% to 2 wt.-% manganese, 0 wt.-% to 4 wt.-% molybdenum, 0 wt.-% to 2 wt.-% niobium, and 0 wt.-% to 1 wt.-% titanium. The connection element can additionally contain admixtures of other elements, including vanadium, aluminum, and nitrogen.

The connection element particularly preferably includes at least 66.5 wt.-% to 89.5 wt.-% iron, 10.5 wt.-% to 20 wt.-% chromium, 0 wt.-% to 1 wt.-% carbon, 0 wt.-% to 5 wt.-% nickel, 0 wt.-% to 2 wt.-% manganese, 0 wt.-% to 2.5 wt.-% molybdenum, 0 wt.-% to 2 wt.-% niobium, and 0 wt.-% to 1 wt.-% titanium. The connection element can additionally contain admixtures of other elements, including vanadium, aluminum, and nitrogen.

The connection element most particularly preferably contains at least 73 wt.-% to 89.5 wt.-% iron, 10.5 wt.-% to 20 wt.-% chromium, 0 wt.-% to 0.5 wt.-% carbon, 0 wt.-% to 2.5 wt.-% nickel, 0 wt.-% to 1 wt.-% manganese, 0 wt.-% to 1.5 wt.-% molybdenum, 0 wt.-% to 1 wt.-% niobium, and 0 wt.-% to 1 wt.-% titanium. The connection element can additionally contain admixtures of other elements, including vanadium, aluminum, and nitrogen.

The connection element contains in particular at least 77 wt.-% to 84 wt.-% iron, 16 wt.-% to 18.5 wt.-% chromium, 0 wt.-% to 0.1 wt.-% carbon, 0 wt.-% to 1 wt.-% manganese, 0 wt.-% to 1 wt.-% niobium, 0 wt.-% to 1.5 wt.-% molybdenum, and 0 wt.-% to 1 wt.-% titanium. The connection element can additionally contain admixtures of other elements, including vanadium, aluminum, and nitrogen.

Chromium-containing steel, in particular so-called "stainless steel" or "corrosion resistant steel", is available economically. Connection elements made of chromium-containing steel also have high rigidity in comparison to many conventional connection elements, made, for example, of copper, which results in an advantageous stability of the connection elements. In addition, compared to many conventional connection elements, for example, those made of titanium, chromium-containing steel has improved solderability, due to higher thermal conductivity.

Particularly suitable chromium-containing steels are steels of the material numbers 1.4016, 1.4113, 1.4509, and 1.4510 in accordance with EN 10 088-2.

The soldering compound preferably contains tin and bismuth, indium, zinc, copper, silver, or compositions thereof. The fraction of tin in the solder composition is 3 wt.-% to 99.5 wt.-%, preferably 10 wt.-% to 95.5 wt.-%, particularly preferably 15 wt.-% to 60 wt.-%. The fraction of bismuth, indium, zinc, copper, silver, or compositions thereof in the solder composition according to the invention is 0.5 wt.-% to 97 wt.-%, preferably 10 wt.-% to 67 wt.-%, where the fraction of bismuth, indium, zinc, copper, or silver can be 0 wt.-%. The solder composition can contain nickel, germanium, aluminum, or phosphorus at a fraction from 0 wt.-% to 5 wt.-%. The solder composition contains most particularly preferably Bi40Sn57Ag3, Sn40Bi57Ag3, Bi59Sn40Ag1, Bi57Sn42Ag1, In97Ag3, In60Sn36.5Ag2Cu1.5, Sn95.5Ag3.8Cu0.7, Bi67In33, Bi33In50Sn17, Sn77.2In20Ag2.8, Sn95Ag4Cu1, Sn99Cu1, Sn96.5Ag3.5, Sn96.5Ag3Cu0.5, Sn97Ag3, or mixtures thereof.

In an advantageous embodiment, the soldering compound contains bismuth. It has been demonstrated that a bismuth-containing soldering compound results in particularly good adhesion of the connection element according to the invention to the pane, by means of which damage to the pane can be avoided. The fraction of bismuth in the soldering compound composition is preferably from 0.5 wt.-% to 97 wt.-%, particularly preferably 10 wt.-% to 67 wt.-%, and most particularly preferably from 33 wt.-% to 67 wt.-%, in particular from 50 wt.-% to 60 wt.-%. In addition to bismuth, the soldering compound preferably contains tin and silver or tin, silver, and copper. In a particularly preferred embodiment, the soldering compound includes at least 35 wt.-% to 69 wt.-% bismuth, 30 wt.-% to 50 wt.-% tin, 1 wt.-% to 10 wt.-% silver, and 0 wt.-% to 5 wt.-% copper. In a most particularly preferred embodiment, the soldering compound contains at least 49 wt.-% to 60 wt.-% bismuth, 39 wt.-% to 42 wt.-% tin, 1 wt.-% to 4 wt.-% silver, and 0 wt.-% to 3 wt.-% copper.

In another advantageous embodiment, the soldering compound contains from 90 wt.-% to 99.5 wt.-% tin, preferably from 95 wt.-% to 99 wt.-%, particularly preferably from 93 wt.-% to 98 wt.-%. In addition to tin, the soldering compound preferably contains from 0.5 wt.-% to 5 wt.-% silver and from 0 wt.-% to 5 wt.-% copper.

The layer thickness of the soldering compound is preferably less than or equal to 600 μm, particularly preferably between 150 μm and 600 μm, in particular less than 300 μm.

The soldering compound flows out with an outflow width of preferably less than 1 mm from the intermediate space between the solder region of the connection element and the electrically conductive structure. In a preferred embodiment, the maximum outflow width is less than 0.5 mm and, in particular, roughly 0 mm. This is particularly advantageous with regard to the reduction of mechanical stresses in the pane, the adhesion of the connection element, and the savings in the amount of solder. The maximum outflow width is defined as the distance between the outer edges of the solder region and the point of the soldering compound crossover, at which the soldering compound drops below a layer thickness of 50 μm. The maximum outflow width is measured on the solidified soldering compound after the soldering process. A desired maximum outflow width is obtained through a suitable selection of soldering compound volume and vertical distance between the connection element and the electrically conductive structure, which can be determined by simple experiments. The vertical distance between the connection element and the electrically conductive structure can be predefined by an appropriate process tool, for example, a tool with an integrated spacer. The maximum outflow width can even be negative, i.e., pulled back into the intermediate space formed by the solder region of the electrical connection element and an electrically conductive structure. In an advantageous embodiment of the pane according to the invention, the maximum outflow width is pulled back in a concave meniscus into the intermediate space formed by the solder region of the electrical connection element and the electrically conductive structure. A concave meniscus is created, for example, by increasing the vertical distance between the spacer and the conductive structure during the soldering process, while the solder is still fluid. The advantage resides in the reduction of mechanical stresses in the pane, in particular, in the critical region that is present with a large soldering compound crossover.

In an advantageous embodiment of the invention, the contact surfaces of the connection elements have spacers, preferably at least two spacers, particularly preferably at least three spacers. The spacers are preferably implemented in one piece with the connection element, for example, by stamping or deep drawing. The spacers preferably have a width from $0.5\times10^{-4}$ m to $10\times10^{-4}$ m and a height from $0.5\times10^{-4}$ m to $5\times10^{-4}$ m, particularly preferably from $1\times10^{-4}$ m to $3\times10^{-4}$ m. By means of the spacers, a homogeneous, uniformly thick, and uniformly fused layer of the soldering compound is obtained. Thus, mechanical stresses between the connection element and the pane can be reduced and the adhesion of the connection element can be improved. This is particularly advantageous with the use of lead-free soldering compounds that can compensate mechanical stresses less well due to their lower ductility compared to lead-containing soldering compounds.

In an advantageous embodiment of the invention, at least one contact bump, which serves for contacting the connection elements with the soldering tool during the soldering process, is arranged on the surface of the connection elements facing away from the substrate. The contact bump is preferably curved convexly at least in the region of contacting with the soldering tool. The contact bump preferably has a height of 0.1 mm to 2 mm, particularly preferably of 0.2 mm to 1 mm. The length and width of the contact bump is preferably between 0.1 and 5 mm, most particularly preferably between 0.4 mm and 3 mm. The contact bumps are preferably implemented in one piece with the connection element, for example, by stamping or deep drawing. For the soldering, electrodes whose contact side is flat can be used. The electrode surface is brought into contact with the contact bump. For this, the electrode surface is arranged parallel to the surface of the substrate. The contact region between the electrode surface and the contact bump forms the solder joint. The position of the solder joint is determined by the point on the convex surface of the contact bump that has the greatest vertical distance from the surface of the substrate. The position of the solder joint is independent of the position of the solder electrode on the connection element. This is particularly advantageous with regard to a reproducible, uniform heat distribution during the soldering process. The heat distribution during the soldering process is determined by the position, the size, the arrangement, and the geometry of the contact bump.

The electrical connection elements have, preferably at least on the contact surface facing the soldering compound, a coating (wetting layer) that contains nickel, copper, zinc, tin, silver, gold, or alloys or layers thereof, preferably silver. By this means, improved wetting of the connection element with the soldering compound and improved adhesion of the connection elements are obtained.

The connection elements according to the invention are preferably coated with nickel, tin, copper, and/or silver. The connection elements according to the invention are particularly preferably provided with an adhesion-promoting layer, preferably made of nickel and/or copper, and, additionally, with a solderable layer, preferably made of silver. The connection elements according to the invention are coated, most particularly preferably, with 0.1 μm to 0.3 μm nickel and/or 3 μm to 20 μm silver. The connection elements can be plated with nickel, tin, copper, and/or silver. Nickel and silver improve the current-carrying capacity and corrosion stability of the connection elements and the wetting with the soldering compound.

The contact elements can optionally also have a coating. A coating of the contact elements is, however, not essential since no direct contact exists between the contact elements and the soldering compound. Thus, no optimization of the wetting properties of the contact elements is required.

In an alternative embodiment, the contact elements have a coating that contains nickel, copper, zinc, tin, silver, gold, or alloys or layers thereof, preferably silver. Preferably, the contact elements are coated with nickel, tin, copper, and/or silver. Most particularly preferably, the contact elements are coated with 0.1 μm to 0.3 μm nickel and/or 3 μm to 20 μm silver. The contact elements can be plated with nickel, tin, copper, and/or silver.

The shape of the electrical connection element can form one or a plurality of solder depots in the intermediate space of the connection element and the electrically conductive structure. The solder depots and wetting properties of the solder on the connection element prevent the outflow of the soldering compound from the intermediate space. Solder depots can be rectangular, rounded, or polygonal in design.

The substrate preferably contains glass, particularly preferably flat glass, float glass, quartz glass, borosilicate glass, and/or soda lime glass. However, the substrate can also contain polymers, preferably polyethylene, polypropylene, polycarbonate, polymethyl methacrylate, polystyrene, polybutadiene, polynitriles, polyesters, polyurethane, polyvinyl chloride, polyacrylate, polyamide, polyethylene terephthalate, and/or copolymers or mixtures thereof. The substrate is preferably transparent. The substrate preferably has a thickness from 0.5 mm to 25 mm, particularly preferably from 1 mm to 10 mm, and most particularly preferably from 1.5 mm to 5 mm.

Optionally, a screenprint that, in the installed state of the pane, conceals the contacting of the pane is applied on the substrate such that the connection elements with the connecting conductors are not discernible from the outside.

The invention further comprises a method for producing a pane comprising the steps:

a) electrical contacting of a connecting conductor with at least two connection elements,
b) applying a soldering compound in each case on at least one contact surface on the bottom of the connection elements,
c) arranging the connection elements with the soldering compound on the electrically conductive structure on the substrate, and
d) soldering the connection elements to the electrically conductive structure, wherein step a) can occur before, during, or after steps b), c) and d).

The electrically conductive structure can be applied on the substrate using methods known per se, for example, by screenprinting methods. The application of the electrically conductive structure can occur before, during, or after the process step b).

The soldering compound is preferably applied to the connection element as a platelet or a flattened drop with a fixed layer thickness, volume, shape, and arrangement. The layer thickness of the soldering compound platelet is preferably less than or equal to 0.6 mm. The shape of the soldering compound platelet preferably corresponds to the shape of the contact surface. If the contact surface is implemented, for example, as a rectangle, the soldering compound platelet preferably has a rectangular shape.

The introduction of energy during the electrical connecting of an electrical connection element and an electrically conductive structure occurs preferably by means of punches, thermodes, piston soldering, microflame soldering, preferably laser soldering, hot air soldering, induction soldering, resistance soldering, and/or with ultrasound.

In a preferred embodiment, the connection elements are soldered on using automation. This is possible since the connection elements according to the invention with a connection web have a comparatively low number of solder points and are thus processable using automation.

Preferably, the connecting conductor is electrically conductively contacted on the connection elements via contact elements. These contact elements are mounted on the connection elements before the electrical contacting of connecting conductors and connection elements. In the context of a modular structure, the contact elements can already be connected to the connection elements in preparation before the first process step, whereas the connecting conductor is not mounted until before, during, or after steps b), c) and d). Preferably, the connecting conductor is not plugged onto the contact elements until after step d). First, the connection elements not yet connected to each other are soldered to contact elements with no spatial obstruction created by the connecting conductor that is not mounted until later in the procedure.

Preferably, the contact elements are welded or soldered on the top of the connection elements. Particularly preferably, the contact elements are fastened on the connection element by electrode resistance welding, induction welding, ultrasonic welding, or friction welding.

In another embodiment, the contact element and the connection element are formed in one piece. In this case, a connecting of the contact element and the connection element is omitted.

The invention further includes the use of a pane with at least two two connection elements and a connecting conductor as a pane with electrically conductive structures, preferably with heating conductors and/or antenna conductors, for motor vehicles, aircraft, watercraft, architectural glazing, and glazing in buildings. The connection elements serve for the connecting of electrically conductive structures of the pane, such as, for instance, heating conductors or antenna conductors, to external electrical systems such as amplifiers, control units, or voltage sources. The invention includes, in particular, the use of the pane according to the invention in rail vehicles or motor vehicles, preferably as a windshield, rear window, side window, and/or glass roof, in particular as a heatable pane or a pane with an antenna function.

The invention is explained in detail with reference to drawings and exemplary embodiments. The drawings are schematic representations and not true to scale. The drawings in no way restrict the invention. They depict:

FIG. 1 a schematic view of a pane according to the invention with two connection elements and a connecting conductor.

Figure 2:
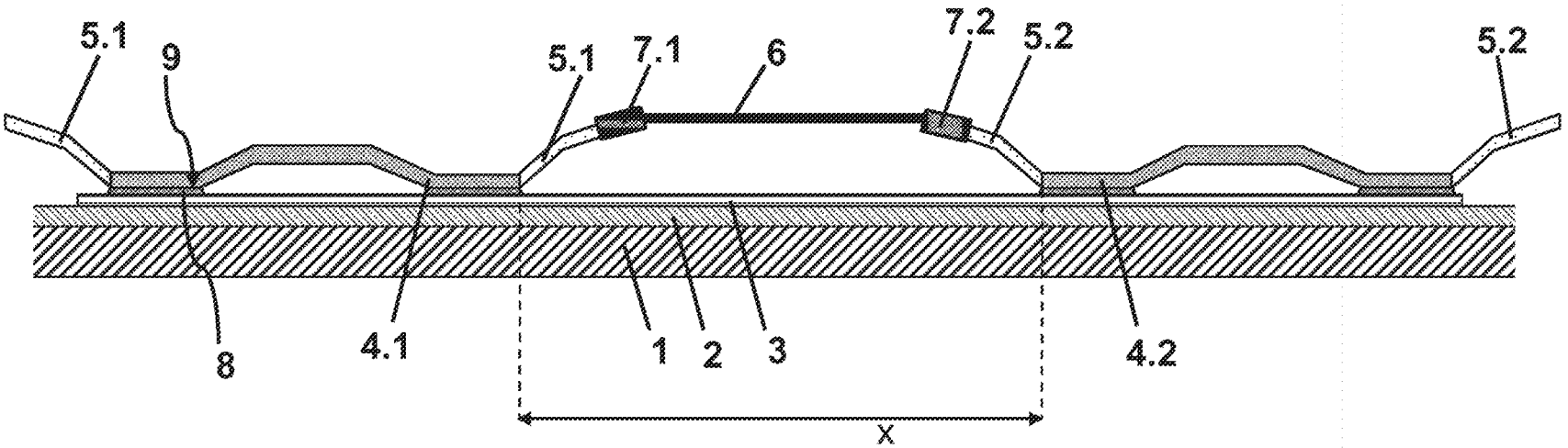

FIG. 2 another embodiment of the pane according to the invention with two connection elements and a connecting conductor.

Figure 3:
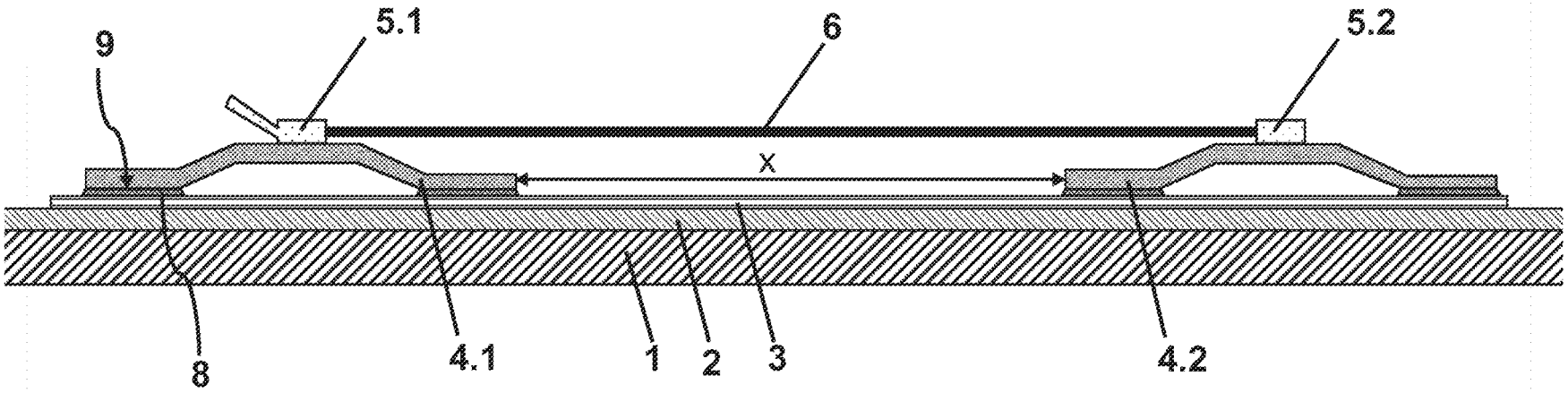

FIG. 3 another embodiment of the pane according to the invention with two connection elements and a connecting conductor.

Figure 4:
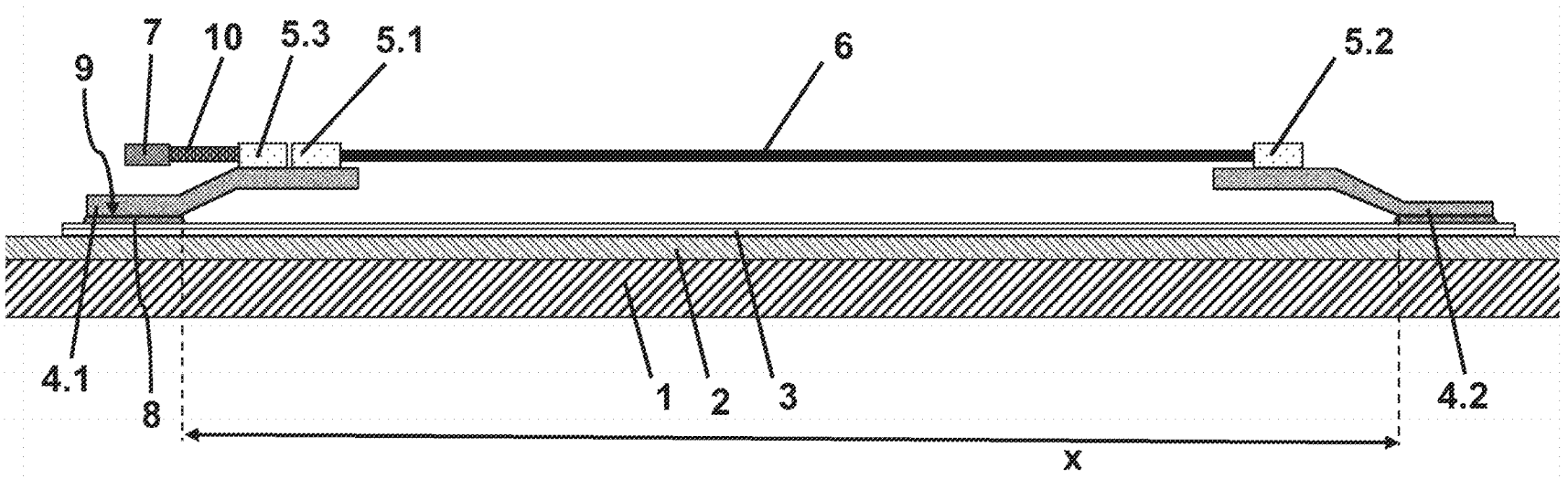

FIG. 4 another embodiment of the pane according to the invention with two connection elements and a connecting conductor.

Figure 5:
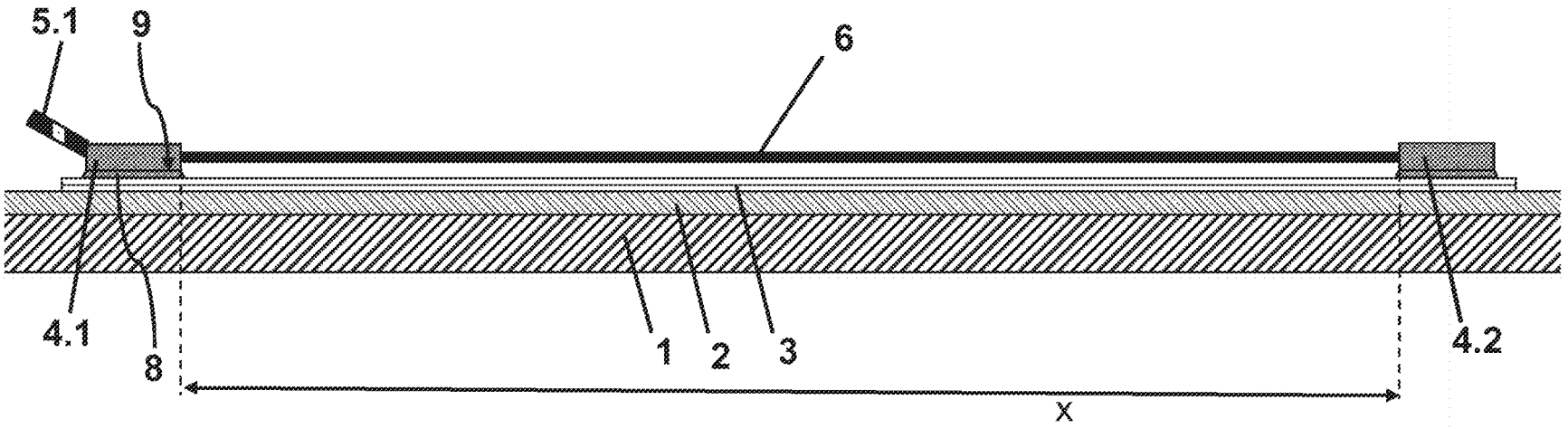

FIG. 5 another embodiment of the pane according to the invention with two connection elements and a connecting conductor.

Figure 6:
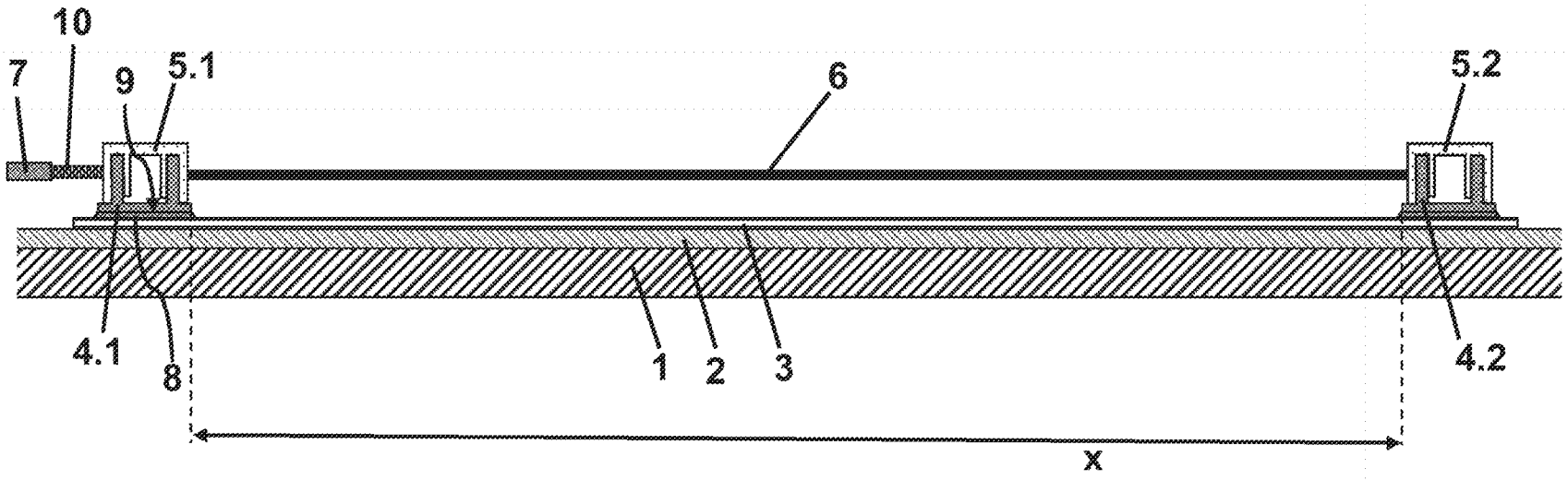

FIG. 6 another embodiment of the pane according to the invention with two connection elements and a connecting conductor.

Figure 7A:
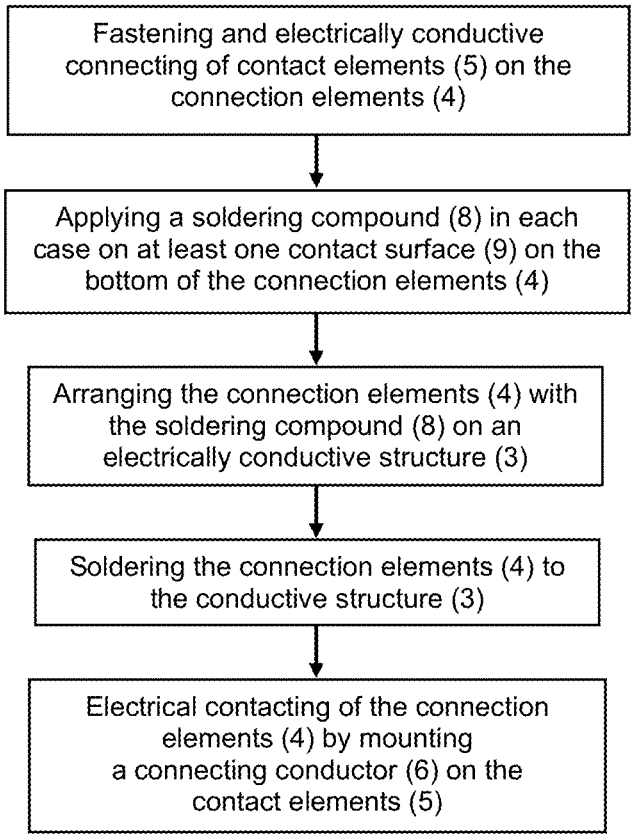

FIG. 7*a* a flowchart of the method according to the invention for producing a pane with connection elements and a connecting conductor.

Figure 7B:
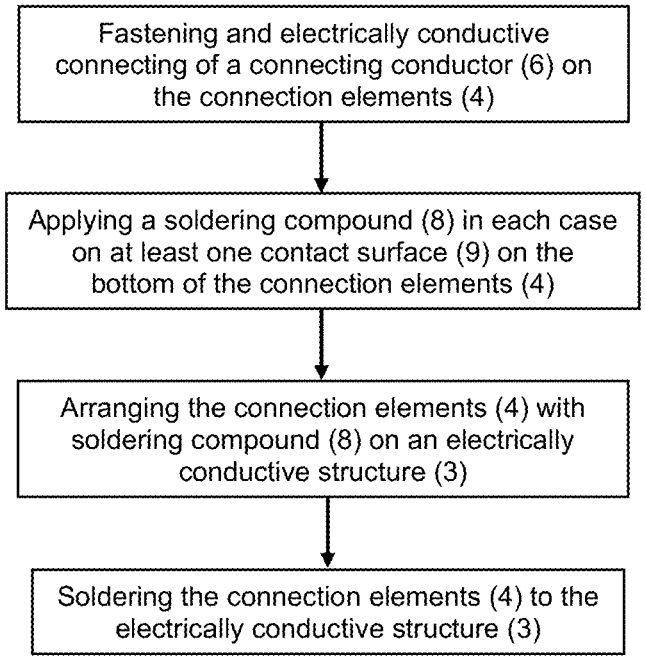

FIG. 7*b* a flowchart of another embodiment of the method according to the invention for producing a pane with connection elements and a connecting conductor.

FIG. 1 depicts a pane according to the invention with two connection elements (4.1, 4.2) and a connecting conductor (6). A masking screenprint (2) is applied on a substrate (1) made of a 3-mm-thick thermally prestressed single pane safety glass made of soda lime glass. The substrate (1) has a width of 150 cm and a height of 80 cm, with two connection elements (4) with a connecting conductor (6) mounted on the shorter side edge in the region of the masking screenprint (2). An electrically conductive structure (2) in the form of a heating conductor structure is applied on the surface of the substrate (1). The electrically conductive structure contains silver particles and glass frits, with the silver fraction being greater than 90%. In the edge region of the pane, the electrically conductive structure (3) is widened to a width of 6 mm and serves as a busbar. The busbar has a layer thickness of 10 μm. In this region, a soldering compound (8) that connects the electrically conductive structure (3) to the contact surfaces (9) of the connection elements (4) is applied. After installation in the vehicle body, the contacting is concealed by the masking screenprint (2). The soldering compound (8) ensures a durable electrical and mechanical connection of the electrically conductive structure (3) to the connection element (4). The soldering compound (8) is lead-free and contains 96.5 wt.-% tin, 3 wt.-% silver, and 0.5 wt.-% copper. The soldering compound (8) has a layer thickness of 250 μm. The connection elements (4.1, 4.2) have an bridge shape. The connection elements include two feet, each with a contact surface (9) on its bottom and a bridge-shaped section that extends between the feet. In the bridge-shaped section, a contact element (5.1, 5.2) is in each case welded on the surface of the connection elements (4.1, 4.2). The contact elements (5.1, 5.2) have a double bridge shape and are aligned parallel to the connection elements (4.1, 4.2). The contact elements (5.1, 5.2) have in each case two contact pins, onto which the connecting conductor (6) or a connection cable can be connected via plug connections. In each case, the connecting conductor (6) is connected via plug connections (7.1, 7.2) on the contact pin of a contact element (5.1, 5.2); the connecting conductor thus electrically conductively connects the two connection elements (4.1) and (4.2). A round copper cable with polymeric sheathing and a conductor cross-section of 2.5 $mm^2$ is used as the connecting conductor (6). Via a still free contact pin of a contact element (5.1, 5.2), a connection cable (not shown) that connects the connection elements (4.1, 4.2) to the onboard electronic system can be plugged in. The current flowing via this connection cable splits into two sub-currents that enter the electrically conductive structure (3) via the solder feet of the connection element (4.1) and one sub-current that is guided via the connecting conductor (6) to the second connection element (4.2). The embodiment depicted here is particularly advantageous with regard to a modular structure of the system. The individual standardized elements can be variably joined together via plug connections according to a modular principle. The use of plug connections is, moreover, advantageous with regard to the reversibility of the connection such that in the event of damaging of the cable, a simple exchange is possible. The electrical connection elements (4.1, 4.2) have a width of 4 mm and a length of 24 mm and are made of steel of the material number 1.4509 in accordance with EN 10 088-2 (Thyssen-Krupp Nirosta® 4509). The material thickness of the connection elements (4.1, 4.2) is 1 mm. The contact elements (5.1, 5.2) have a height of 0.8 mm, a width of 6.3 mm, and a length of 27 mm. The contact elements (5.1, 5.2) are made of copper of the material number CW004A (Cu-ETP). This material combination of a lead-free soldering compound (8) with connection elements (4.1, 4.2) made of steel and copper-containing contact elements (5.1, 5.2) is particularly advantageous, since the connection element has a coefficient of thermal expansion adapted to the substrate (1), whereas the contact elements (5.1, 5.2) have a sufficiently high conductivity of 1.8 μohm·cm. The electrical resistance of the contact elements (5.1, 5.2) is thus selected such that a high voltage drop on the contact elements (5.1, 5.2) is avoided. The connection element itself is in turn made of a material with a suitable coefficient of thermal expansion (difference with the CTE of the substrate of less than $5\times10^{-6}$/° C.). By means of the different material compositions of the connection elements (4.1, 4.2) and of the contact elements (5.1, 5.2), the advantageous characteristics of the materials used and the relevant points are optimally utilized. The contact surfaces (9) of the first connection element (4.1) and of the second connection element (4.2) nearest each other have a distance x between them of 190 mm. The connection elements (4.1, 4.2) according to the invention with a connecting conductor (6) enable a substantial improvement of the current-carrying capacity, even with the use of busbars with small conductor cross-sections and only two end connection elements. Additional solder points are not necessary.

FIG. 2 depicts another embodiment of the pane according to the invention with two connection elements (4.1, 4.2) and a connecting conductor (6). A masking screenprint (2) is applied on a substrate (1) made of a 3-mm-thick thermally prestressed single pane safety glass made of soda lime glass. The substrate (1) has a width of 150 cm and a height of 80 cm, with two connection elements (4) with a connecting conductor (6) mounted on the shorter side edge in the region of the masking screenprint (2). An electrically conductive structure (2) in the form of a heating conductor structure is applied on the surface of the substrate (1). The electrically conductive structure contains silver particles and glass frits, with the silver fraction being greater than 90%. In the edge region of the pane, the electrically conductive structure (3) is widened to a width of 6 mm and serves as a busbar. The busbar has a layer thickness of 10 μm. In this region, a soldering compound (8) that connects the electrically conductive structure (3) to the contact surfaces (9) of the connection elements (4) is applied. After installation in the vehicle body, the contacting is concealed by the masking screenprint (2). The soldering compound (8) ensures a durable electrical and mechanical connection of the electrically conductive structure (3) to the connection element (4). The soldering compound (8) is a lead-containing soldering compound with the composition Pb70Sn27Ag3. The soldering compound (8) has a layer thickness of 250 μm. The electrical connection elements (4.1, 4.2) have a width of 4 mm and a length of 24 mm and are made of copper of the material number CW004A (Cu-ETP). The material thickness of the connection elements (4.1, 4.2) is 0.8 mm. The contact elements (5.1, 5.2) have a height of 0.8 mm, a width of 6.3 mm, and a length of 8 mm. The contact elements (5.1, 5.2) are made of copper of the material number CW004A (Cu-ETP). The connection elements (4.1, 4.2) have a bridge shape. The connection elements include two feet, each with a contact surface (9) on its bottom and a bridge-shaped section that extends between the feet. In this embodiment, the connection elements (4.1, 4.2) and the contact elements (5.1, 5.2) are formed in one piece, with the first contact element (5.1) mounted in the form of two contact pins on the first connection element (4.1), whereas the second connection element (4.2) also has two contact pins that form the second contact element (5.2). The contact elements (5.1, 5.2) extend the connection elements (4.1, 4.2) in the longitudinal direction and are curved upward away from the substrate. Thus, the connection elements (4.1, 4.2) and the contact elements (5.1, 5.2) together yield a double bridge shape. The connecting conductor (6) is in each case connected on the contact pin of a contact element (5.1, 5.2) via plug connections (7.1, 7.2); the connecting conductor thus electrically conductively connects the two connection elements (4.1) and (4.2). A round copper cable with polymeric sheathing and a conductor cross-section of 2.5 $mm^2$ is used as the connecting conductor (6). Via a still free contact pin of a contact element (5.1, 5.2), a connection cable (not shown) that connects the connection elements (4.1, 4.2) to the onboard electronic system can be plugged in. The current flowing via this connection cable splits into two sub-currents that enter the electrically conductive structure (3) via the solder feet of the connection element (4.1) and one sub-current that is guided via the connecting conductor (6) to the second connection element (4.2). This embodiment is particularly advantageous with connection elements (4.1, 4.2) formed in one piece with contact elements (5.1, 5.2), since these can be stamped in one step from a single metal sheet. The contact surfaces (9) of the first connection element (4.1) and of the second connection element (4.2) nearest each other have a distance x between them of 190 mm. The connection elements (4.1, 4.2) according to the invention with a connecting conductor (6) enable a substantial improvement of the current-carrying capacity, even with the use of busbars with small conductor cross-sections and only two end connection elements. Additional solder points are not necessary.

FIG. 3 depicts another embodiment of the pane according to the invention with two connection elements (4.1, 4.2) and a connecting conductor (6). A masking screenprint (2) is applied on a substrate (1) made of a 3-mm-thick thermally prestressed single pane safety glass made of soda lime glass. The substrate (1) has a width of 150 cm and a height of 80 cm, with two connection elements (4) with a connecting conductor (6) mounted on the shorter side edge in the region of the masking screenprint (2). An electrically conductive structure (2) in the form of a heating conductor structure is applied on the surface of the substrate (1). The electrically conductive structure contains silver particles and glass frits, with the silver fraction being greater than 90%. In the edge region of the pane, the electrically conductive structure (3) is widened to a width of 6 mm and serves as a busbar. The busbar has a layer thickness of 10 urn. In this region, a soldering compound (8) that connects the electrically conductive structure (3) to the contact surfaces (9) of the connection elements (4) is applied. After installation in the vehicle body, the contacting is concealed by the masking screenprint (2). The soldering compound (8) ensures a durable electrical and mechanical connection of the electrically conductive structure (3) to the connection elements (4). The shape and material composition of the connection elements (4.1, 4.2) as well as the soldering compound (8) corresponds to FIG. 1. The contact elements (5.1, 5.2) consist of crimps, which are fastened on the ends of the connecting conductor (6) by means of a crimp connection and are welded onto the bridge-shaped section of the connection elements (4.1, 4.2). The connecting conductor (6) thus represents an electrically conductive connection of the first connection element (4.1) and of the second connection element (4.2). A round copper cable with polymeric sheathing and a conductor cross-section of 2.5 $mm^2$ is used as the connecting conductor (6). The contact elements (5.1, 5.2) are made of copper of the material number CW004A (Cu-ETP). The first contact element (5.1) includes a contact pin, onto which a connection cable (not shown) that connects the connection elements (4.1, 4.2) to the onboard electronic system can be plugged in by means of a plug connector. The contact surfaces (9) of the first connection element (4.1) and of the second connection element (4.2) nearest each other have a distance x between them of 190 mm. The connection elements (4.1, 4.2) according to the invention with a connecting conductor (6) enable a substantial improvement of the current-carrying capacity, even with the use of busbars with small conductor cross-sections and only two end connection elements. Additional solder points are not necessary. The use of crimp connections is advantageous primarily with regard to cost-effective production of the pane according to the invention.

FIG. 4 depicts another embodiment of the pane according to the invention with connection elements and a connecting conductor. A masking screenprint (2) is applied on a substrate (1) made of a 3-mm-thick thermally prestressed single pane safety glass made of soda lime glass. The substrate (1) has a width of 150 cm and a height of 80 cm, with two connection elements (4) with a connecting conductor (6) mounted on the shorter side edge in the region of the masking screenprint (2). An electrically conductive structure (2) in the form of a heating conductor structure is applied on the surface of the substrate (1). The electrically conductive structure contains silver particles and glass frits, with the silver fraction being greater than 90%. In the edge region of the pane, the electrically conductive structure (3) is widened to a width of 6 mm and serves as a busbar. The busbar has a layer thickness of 10 μm. In this region, a soldering compound (8) that connects the electrically conductive structure (3) to the contact surfaces (9) of the connection elements (4) is applied. After installation in the vehicle body, the contacting is concealed by the masking screenprint (2). The soldering compound (8) ensures a durable electrical and mechanical connection of the electrically conductive structure (3) to the connection elements (4). The connection elements (4.1, 4.2) have in each case a contact surface (9), via which they are soldered to the electrically conductive structure (3) by means of the soldering compound (8). The material composition of the connection elements (4.1, 4.2) as well as the soldering compound (8) corresponds to FIG. 1. The contact elements (5.1, 5.2) consist of crimps, which are fastened on the ends of the connecting conductor (6) by means of a crimp connection and are welded onto a higher section of the connection elements (4.1, 4.2). The connecting conductor (6) thus represents an electrically conductive connection of the first connection element (4.1) and of the second connection element (4.2). A round copper cable with polymeric sheathing and a conductor cross-section of 2.5 $mm^2$ is used as the connecting conductor (6). The first connection element (4.1) has a third contact element (5.3), which is also mounted on the higher section of the connection element (4.1) and electrically conductively connects a connection cable (10) to the connection element (4.1). The third contact element (5.3) is also a crimp, which surrounds the connection cable (10) and is welded on the first connection element. The contact elements (5.1, 5.2, 5.3) are made of steel of the material number 1.4016 in accordance with EN 10 088-2 (ThyssenKrupp Nirosta® 4016). The contact surfaces (9) of the first connection element (4.1) and of the second connection element (4.2) nearest each other have a distance x between them of 190 mm. The connection elements (4.1, 4.2) according to the invention with a connecting conductor (6) enable a substantial improvement of the current-carrying capacity, even with the use of busbars with small conductor cross-sections and only two end connection elements. Additional solder points are not necessary. The use of crimp connections is advantageous primarily with regard to cost-effective production of the pane according to the invention.

FIG. 5 depicts another embodiment of the pane according to the invention with connection elements and a connecting conductor. A masking screenprint (2) is applied on a substrate (1) made of a 3-mm-thick thermally prestressed single pane safety glass made of soda lime glass. The substrate (1) has a width of 150 cm and a height of 80 cm, with two connection elements (4) with a connecting conductor (6) mounted on the shorter side edge in the region of the masking screenprint (2). An electrically conductive structure (2) in the form of a heating conductor structure is applied on the surface of the substrate (1). The electrically conductive structure contains silver particles and glass frits, with the silver fraction being greater than 90%. In the edge region of the pane, the electrically conductive structure (3) is widened to a width of 6 mm and serves as a busbar. The busbar has a layer thickness of 10 μm. In this region, a soldering compound (8) that connects the electrically conductive structure (3) to the contact surfaces (9) of the connection elements (4) is applied. After installation in the vehicle body, the contacting is concealed by the masking screenprint (2). The soldering compound (8) ensures a durable electrical and mechanical connection of the electrically conductive structure (3) to the connection elements (4). The connection elements (4.1, 4.2) have in each case a contact surface (9), via which they are soldered to the electrically conductive structure (3) by means of the soldering compound (8). The material composition of the connection elements (4.1, 4.2) as well as the soldering compound (8) corresponds to FIG. 4. The connection elements (4.1, 4.2) consist of crimps, which are fastened on the ends of the connecting conductor (6) by means of a crimp connection and are soldered directly on the electrically conductive structure (3) by means of the soldering compound (8). The connecting conductor (6) thus represents an electrically conductive connection of the first connection element (4.1) and of the second connection element (4.2). A round copper cable with polymeric sheathing and a conductor cross-section of 2.5 $mm^2$ is used as the connecting conductor (6). The connection elements (4.1, 4.2) are made of steel of the material number 1.4016 in accordance with EN 10 088-2 (ThyssenKrupp Nirosta® 4016). The contact surfaces (9) of the first connection element (4.1) and of the second connection element (4.2) nearest each other have a distance x between them of 190 mm. The first connection element (4.1) has a contact pin that serves as contact element (5.1). A connection cable (not shown) that connects the connection elements (4.1, 4.2) to the onboard electronic system is connected via this contact element (5.1). The connection elements (4.1, 4.2) according to the invention with a connecting conductor (6) enable a substantial improvement of the current-carrying capacity, even with the use of busbars with small conductor cross-sections and only two end connection elements. Additional solder points are not necessary. The use of crimp connections is advantageous primarily with regard to cost-effective production of the pane according to the invention.

FIG. 6 depicts another embodiment of the pane according to the invention with connection elements and a connecting conductor. A masking screenprint (2) is applied on a substrate (1) made of a 3-mm-thick thermally prestressed single pane safety glass made of soda lime glass. The substrate (1) has a width of 150 cm and a height of 80 cm, with two connection elements (4) with a connecting conductor (6) mounted on the shorter side edge in the region of the masking screenprint (2). An electrically conductive structure (2) in the form of a heating conductor structure is applied on the surface of the substrate (1). The electrically conductive structure contains silver particles and glass frits, with the silver fraction being greater than 90%. In the edge region of the pane, the electrically conductive structure (3) is widened to a width of 6 mm and serves as a busbar. The busbar has a layer thickness of 10 μm. In this region, a soldering compound (8) that connects the electrically conductive structure (3) to the contact surfaces (9) of the connection elements (4) is applied. After installation in the vehicle body, the contacting is concealed by the masking screenprint (2). The soldering compound (8) ensures a durable electrical and mechanical connection of the electrically conductive structure (3) to the connection elements (4). The connection elements (4.1, 4.2) have in each case a contact surface (9), via which the connection elements are soldered on the electrically conductive structure (3) by means of the soldering compound (8). The connection elements (4.1, 4.2) are implemented in the form of snaps, with the bottom, male part of the snap serving as a connection element (4.1, 4.2) and the top, female part of the snap functioning as a contact element (5.1, 5.2). The material composition of the connection elements (4.1, 4.2) as well as the soldering compound (8) corresponds to FIG. 1. The contact elements (5.1, 5.2) are made of the same material as the connection elements (4.1, 4.2). In each case, one end of the connecting conductor (6) is electrically conductively contacted on the contact elements (5.1, 5.2) such that this represents an electrically conducting connection of the two connection elements (4.1, 4.2). The contact surfaces (9) of the first connection element (4.1) and of the second connection element (4.2) nearest each other have a distance x between them of 190 mm. A connection cable (10) that connects the connection elements (4.1, 4.2) to the onboard electronic system is applied on the first contact element (5.1). The connection elements (4.1, 4.2) according to the invention with a connecting conductor (6) enable a substantial improvement of the current-carrying capacity, even with the use of busbars with small conductor cross-sections and only two end connection elements. Additional solder points are not necessary. The use of connection elements in the form of snaps is advantageous primarily with regard to a reversible attaching of the connecting conductor and of the connection cable. In the event of a cable break, the solder connection does not have to be undone and the relevant cable can simply be replaced.

FIG. 7*a* depicts a flowchart of the method according to the invention for producing a pane with connection elements and a connecting conductor. In a first step, contact elements (5) are electrically conductively fastened on the connection elements (4). Only after that are the connection elements soldered on the electrically conductive structure (3) in the subsequent steps by means of a soldering compound (8). In a final step, the connection elements (4) are electrically conductively contacted with each other by mounting a connecting conductor (6) on the contact elements (5). The embodiment depicted here of the method according to the invention is particularly suitable in connecting conductors that are to be reversibly mounted, such as, for instance, connecting conductors contacted via plug connections. These can be mounted even subsequently in a simple manner and represent no spatial obstruction during the soldering process, so long as they are not mounted until later. Furthermore, the method according to the invention according to FIG. 7*a* facilitates the soldering process. During the soldering of the first connection element, the connecting conductor and the other connection elements form a bothersome mass, with the forces acting on the first connection element leading to slippage of the first connection element during the soldering process. This can be prevented by a subsequent connection of the connection elements via plug connections.

FIG. 7*b* depicts a flowchart of another embodiment of the method according to the invention for producing a pane with connection elements and a connecting conductor. First, a connecting conductor (6) is electrically conductively contacted with the connection elements (4.1, 4.2). This can take place either directly, for example, by soldering the conductor directly onto the connection, or indirectly, for example, via contact elements. In the following steps, this arrangement is soldered on an electrically conductive structure (3) via the contact surfaces (9) of the connection elements (4) by means of a soldering compound (8). This embodiment of the method according to the invention is preferably used if the connection between the connecting conductor and the connection element, or between the connection element and the contact element, is irreversible.

In the following, the invention is compared using a series of tests of panes with connection elements and connecting conductors according to the prior art and the pane according to the invention with connection elements and connecting conductors.

EXAMPLE 1

The structure of the pane according to the invention with two connection elements (4) and one connecting conductor (6) corresponds to that depicted in FIG. 3, wherein the distance x between the contact surfaces (9) of the connection elements (4.1, 4.2) nearest each other was 285 mm.

COMPARATIVE EXAMPLE 2

A connecting conductor with 6 connection elements at intervals of 57 mm each and a total length of 285 mm was soldered analogously to Example 1 onto the arrangement described in FIG. 1 made up of a substrate and an electrically conductive structure. The connecting conductor is an uninsulated, braided, nickel-plated copper conductor with a conductor cross-section of 3 $mm^2$, with the connection elements formed by crimps. Each of the connection elements was soldered onto the electrically conductive structure by means of a lead-free soldering compound containing 65 wt.-% indium, 30 wt.-% tin, 4.5 wt.-% silver as well as 0.5 wt.-% copper. Such a connecting conductor can be obtained commercially from the company Antaya.

Table 1 shows the results of a series of tests of the connecting conductor according to the invention (Example 1) and of the connecting conductor according to the prior art (Comparative Example 2). In addition to an adequate current-carrying capacity, the maximum temperature increase of the busbar is of critical significance. This is specified by many auto manufacturers at a maximum threshold value of 60° C. In addition, the costs of the different connecting conductors were compared.

TABLE 1

| | $\Delta T_{max}$ (busbar) |
|---|---|
| Example 1 | ca. 12° C. |
| Comparative Example 2 | ca. 5° C. |

Both the connecting conductor according to the invention and the connecting conductor according to the prior art complied with the threshold value for the maximum temperature increase of the busbar. However, the connecting conductor according to the invention is substantially more cost-effective. This results primarily from the material-intensive design of the connecting conductor according to the prior art. According to the prior art, a substantially more massive conductor with a slightly greater conductor cross-section is needed for compliance with the temperature threshold value and for obtaining an adequate current-carrying capacity. The high number of connection elements also serves for the obtaining of a sufficiently high current-carrying capacity as well as the prevention of development of noise in the moving automobile. A correspondingly high current-carrying capacity can, however, as it was possible to demonstrate, also be obtained using the connecting conductor according to the invention with only two connection elements. Fixing of the connecting conductor according to the invention via additional connection elements is superfluous. A possible development of noise is prevented by a polymer-containing sheathing of the connecting conductor. Through the substantial reduction of solder points, the connecting conductor with connection elements according to the invention can be soldered within a shorter period of time. This time savings is associated with a further reduction in production costs. Moreover, automation of the soldering process is enormously simplified by a smaller number of solder points. The solution according to the invention further results in a substantial reduction in material costs since the connecting conductor with connection elements according to the invention is less massively worked. The connecting conductor according to the prior art (Comparative Example 2) has, due to the large number of connection elements (6 crimps) and solder depots, a substantially higher total material consumption. On the whole, compared to the prior art (Comparative Example 2), the connecting conductor according to the invention (Example 1) is far more cost-effective and economical both in terms of production and in terms of further processing.

LIST OF REFERENCE CHARACTERS

1 transparent substrate
2 masking screenprint
3 conductive structure
4 connection elements
4.1 first connection element
4.2 second connection element
5 contact elements
5.1 first contact element
5.2 second contact element
5.3 third contact element
6 connecting conductor
7 plug connections
8 soldering compound
9 contact surfaces
10 connection cable
x distance between the contact surfaces of the adjacent connection elements nearest each other

The invention claimed is:

1. A pane, comprising:
a substrate;
an electrically conductive structure on at least one subregion of the substrate;
two or more electrical connection elements on at least one subregion of the electrically conductive structure,
wherein each electrical connection element is configured with a bottom having at least one contact surface;

a soldering compound, which connects each contact surface of each electrical connection element to the electrically conductive structure; and a connecting conductor, which electrically conductively connects each electrical connection element to each other electrical connection element, wherein the connecting conductor comprises an electrically conductive core and an electrically nonconductive sheath, and wherein a first contact surface of a first electrical connection element is a distance of at least 70 mm from a second contact surface of a second electrical connection element, wherein each electrical connection element is connected to the connecting conductor via a top of each electrical connection element, and wherein the connecting conductor spans the electrical connection elements.

2. The pane according to claim 1, wherein the distance between the first contact surface and the second contact surface is at least 100 mm.

3. The pane according to claim 1, wherein the distance between the first contact surface and the second contact surface is at least 150 mm.

4. The pane according to claim 1, wherein the distance between the first contact surface and the second contact surface is at least 200 mm.

5. The pane according to claim 1, wherein the connecting conductor has a conductor cross-section less than or equal to 6 $mm^2$.

6. The pane according to claim 1, wherein the connecting conductor has a conductor cross-section less than or equal to 4 $mm^2$.

7. The pane according to claim 1, wherein the connecting conductor has a conductor cross-section less than or equal to 2.5 $mm^2$.

8. The pane according to claim 1, wherein the electrically conductive structure comprises at least one busbar with a conductor cross-section less than 0.3 $mm^2$.

9. The pane according to claim 1, wherein the electrically conductive structure comprises at least one busbar with a conductor cross-section less than 0.1 $mm^2$.

10. The pane according to claim 1, wherein the electrically conductive structure comprises at least one busbar with a conductor cross-section less than 0.06 $mm^2$.

11. The pane according to claim 1, comprising two electrical connection elements, and wherein the connecting conductor has a length less than or equal to 300 mm.

12. The pane according to claim 1, comprising at least three electrical connection elements, and wherein the connecting conductor has a length greater than 300 mm.

13. The pane according to claim 1, wherein each of the electrical connection elements contain one or more of titanium, iron, nickel, cobalt, molybdenum, copper, zinc, tin, manganese, niobium, chromium, and alloys thereof.

14. The pane according to claim 1, wherein the at least two electrical connection elements are electrically conductively contacted to the connecting conductor via contact elements.

15. The pane according to claim 14, wherein the contact elements comprise contact pins, which are electrically conductively contacted to the connecting conductor.

16. The pane according to claim 1, wherein the electrically conductive structure contains silver.

17. The pane according to claim 1, wherein the soldering compound contains one or more of tin, bismuth, indium, zinc, copper, silver, lead, and mixtures thereof, and alloys thereof.

18. The pane according to claim 1, wherein the substrate contains one or more of glass and polymers.

19. The pane according to claim 1, wherein the substrate contains one or more of flat glass, float glass, quartz glass, borosilicate glass, soda lime glass, and polymethyl methacrylate.

20. A method of using a pane having electrically conductive structures, comprising:

providing a pane according to claim 1, wherein the electrically conductive structure includes one or more of a heating conductor and an antenna conductor; and installing the pane in a motor vehicle, an aircraft, a watercraft, an architectural glazing, or a glazing in a building.

21. A method for producing a pane that includes a substrate;

an electrically conductive structure on at least one subregion of the substrate;

at least two electrical connection elements on at least one subregion of the electrically conductive structure, wherein each electrical connection element is configured with a bottom having at least one contact surface;

a soldering compound, which connects each contact surface of each electrical connection element to the electrically conductive structure; and a connecting conductor, which electrically conductively connects each electrical connection element to each other electrical connection element, wherein the connecting conductor comprises an electrically conductive core and an electrically nonconductive sheath, and wherein a first contact surface of a first electrical connection element is a distance of at least 70 mm from a second contact surface of a second electrical connection element, wherein each electrical connection element is connected to the connecting conductor via a top of each electrical connection element, and wherein the connecting conductor spans the electrical connection elements, the method comprising:

a) electrically conductively contacting the connecting conductor with the at least two electrical connection elements, wherein the connecting conductor comprises the electrically conductive core and the electrically nonconductive sheath;

b) applying the soldering compound to the at least one contact surface on the bottom of each electrical connection element;

c) arranging each electrical connection element with the soldering compound on the electrically conductive structure on the substrate; and d) soldering each electrical connection element to the electrically conductive structure, wherein step a) can occur before, during, or after steps b), c) and d).

22. The method according to claim 21, wherein electrically conductively contacting includes contacting the connecting conductor via contact elements on the at least two electrical connection elements.

* * * * *